US008684203B2

(12) United States Patent
Krautkrämer

(10) Patent No.: US 8,684,203 B2
(45) Date of Patent: Apr. 1, 2014

(54) SCREW CLOSURE WITH FLEXIBLE BAND

(75) Inventor: Günter Krautkrämer, Budenheim (DE)

(73) Assignee: Bericap GmbH & Co. KG, Budenheim (DE)

( * ) Notice: Subject to any disclaimer, the term of this patent is extended or adjusted under 35 U.S.C. 154(b) by 0 days.

(21) Appl. No.: 13/814,306

(22) PCT Filed: Aug. 3, 2011

(86) PCT No.: PCT/EP2011/063373

§ 371 (c)(1),
(2), (4) Date: Apr. 2, 2013

(87) PCT Pub. No.: WO2012/017011

PCT Pub. Date: Feb. 9, 2012

(65) Prior Publication Data

US 2013/0213923 A1 Aug. 22, 2013

(30) Foreign Application Priority Data

Aug. 6, 2010 (DE) ..... 10 2010 039 036

(51) Int. Cl.
*B65D 41/34* (2006.01)
*B65D 41/48* (2006.01)

(52) U.S. Cl.
CPC ..... *B65D 41/34* (2013.01); *B65D 41/48* (2013.01)
USPC ..... 215/252; 215/253; 215/254; 215/258; 215/317; 215/340; 215/353; 220/784; 220/786; 220/787; 220/788

(58) Field of Classification Search
CPC ..... B65D 41/34; B65D 41/48
USPC ..... 215/252, 340, 353, 253, 254, 258, 317; 220/784, 786, 787, 788
See application file for complete search history.

(56) References Cited

U.S. PATENT DOCUMENTS

| | | | | |
|---|---|---|---|---|
| 4,801,031 | A * | 1/1989 | Barriac | 215/252 |
| 5,007,545 | A | 4/1991 | Imbery, Jr. | |
| 6,371,317 | B1 | 4/2002 | Krueger | |
| 6,405,886 | B1 | 6/2002 | Gearhart et al. | |

FOREIGN PATENT DOCUMENTS

| | | |
|---|---|---|
| EP | 0 541 466 A1 | 5/1993 |
| WO | 00 23343 A1 | 4/2000 |

* cited by examiner

*Primary Examiner* — Anthony Stashick
*Assistant Examiner* — Elizabeth Volz
(74) *Attorney, Agent, or Firm* — Paul & Paul

(57) ABSTRACT

A screw closure (10) has a screw cap (1) and a tamperproof band (5). The screw cap (1) has a head plate (2) with a cylindrical lateral cap surface (3,provided with an internal thread (4) and wherein the tamperproof band (5) has a flexible band (6) and is connected to the lower periphery of the lateral cap surface (3) via one or more easy-tear elements (7). In order to create a screw closure which has a flexible band and, even with relatively large tolerance deviations between the closure and container neck, still ensures that the tamperproof band can be reliably torn off is thus providing enhanced functional reliability. The flexible band (6) is a continuously encircling flexible band which, distributed over its circumference, has portions (8) which can be extended easily and, therebetween, portions (9) which are less easy to extend.

16 Claims, 3 Drawing Sheets

Figure 1:
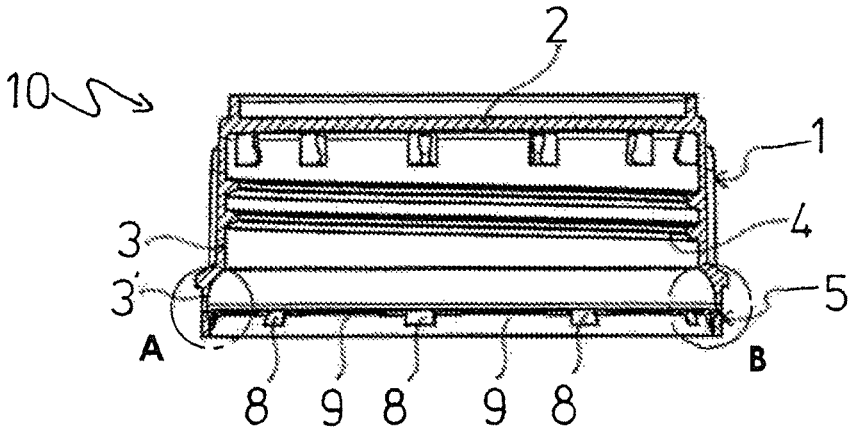

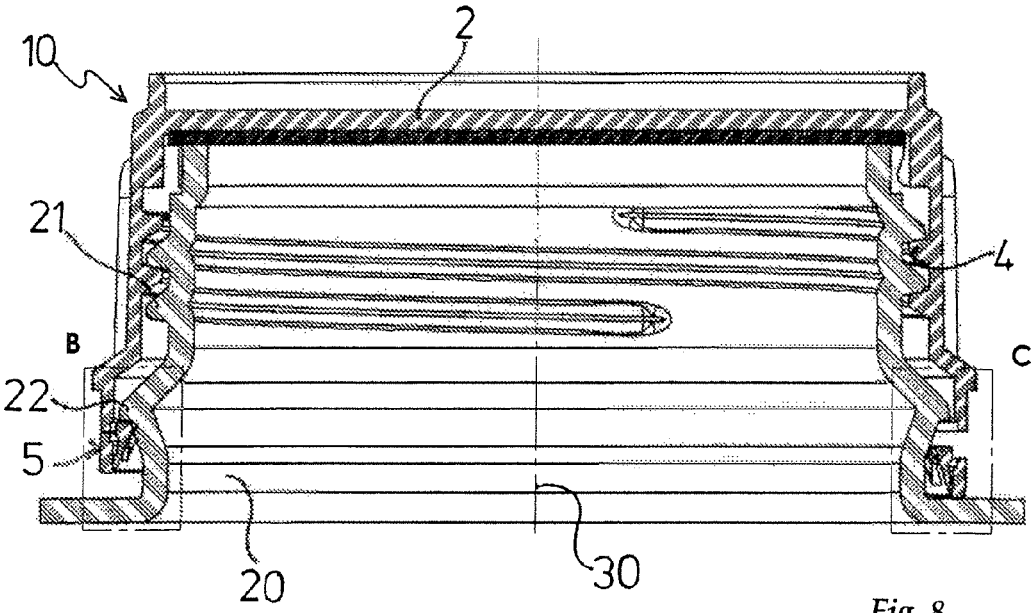
Fig. 8
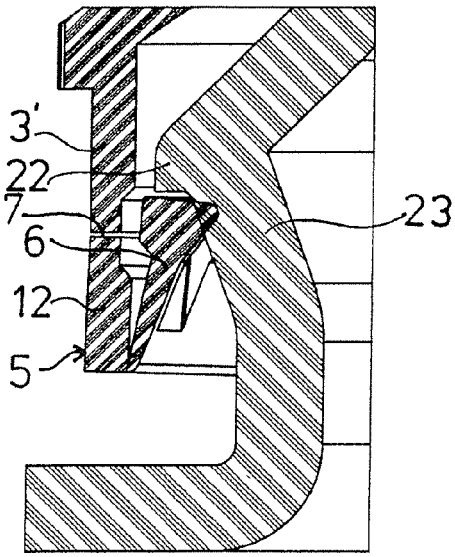
B Fig. 9
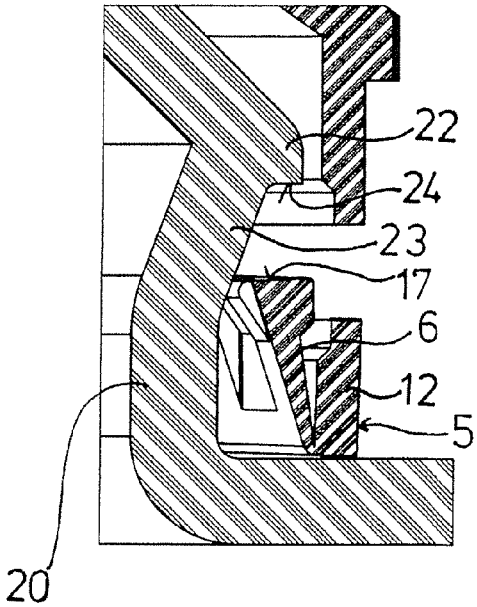
C Fig. 10

SCREW CLOSURE WITH FLEXIBLE BAND

The present invention concerns a screw closure comprising a screw cap and a tamperproof band, wherein the screw cap has a head plate with a cylindrical cap peripheral wall portion provided with a female thread and wherein the tamperproof band has a flexible band and is connected to the lower edge of the cap peripheral wall portion by way of one or more easily tearable elements, wherein the flexible band is in the form of a continuously peripherally extending flexible band which distributed over its periphery has a plurality of more easily stretchable portions and therebetween relatively less easily stretchable portions, and wherein the more easily stretchable portions are of a smaller wall cross-section, in particular in the folded-over condition, a smaller wall thickness as measured in the radial direction, than the less easily stretchable portions.

There are numerous screw closures of that kind in use, in particular for container mouths or lower closure portions, the diameter of which is 38 mm or less.

In the present application the term "flexible band" is used to denote the part of a tamperproof band, that can be folded over and which admittedly upon and directly after manufacture extends approximately in an axial prolongation of the cap peripheral wall portion and an outer tamperproof band portion, which however can be folded over inwardly and upwardly (in the direction of the head plate) and whose free end has a contact surface which faces upwardly in the folded-over condition and which upon release of a screw cap bears against the underside of a securing ring when it is on a lower closure portion or a corresponding container neck below the male thread matching the screw cap.

Flexible bands of that kind are known in many different configurations and in particular also in the form of separate segments which can be individually folded over, and with interruptions which are intended to make it easier to fit an intact closure and in particular the intact tamperproof band on the container neck or a corresponding lower portion. For proper functioning, the free inside diameter of the flexible band, which diameter is set in the folded-over condition, must be markedly smaller than the outside diameter of the securing ring on the container neck or the lower closure portion, behind which the flexible band is intended to engage.

So that the flexible band which is connected to the outer portion of the tamperproof band by way of a weak portion acting as a hinge does not simply unroll downwardly under the action of an axial force on the free end, more specifically upon coming into engagement with the underside of the securing ring during unscrewing of the screw cap, and fold back into a position in which it substantially forms an axial prolongation of the outer portion of the tamperproof band and in that way can slide over the securing ring, it must on the one hand have a degree of stiffness which is adequate in itself and in the folded-over condition it must extend upwardly at a relatively acute angle (with respect to the cylindrical inside wall of the outer tamperproof band portion). With a suitably acute angle, an axial force acts predominantly in the longitudinal direction of the more or less cylindrical or slightly conical wall of the flexible band and exerts a corresponding axial tensile force by way of the hinge portion on the outer portion of the tamperproof band, that force leading to tearing of the easily tearable connection or connections between the tamperproof band and the lower edge of the screw cap.

If however that angle between the flexible band and the axis of the screw cap or the outer tamperproof band portion (that is substantially parallel to the axis) becomes too large a considerable component of an axially directed force also acts perpendicularly to the wall of the flexible band and not in its longitudinal direction, which causes the flexible band to fold over or "unroll" as referred to hereinbefore, without the easily tearable connections between the tamperproof band and the screw cap tearing away.

It is therefore substantially an important consideration that a screw cap and its flexible band are sufficiently accurately matched in their dimensions to a bottle neck or a corresponding lower closure portion so that, after application of the screw cap to a container neck or a lower closure portion, when the flexible band bears against the outer periphery of the container neck beneath the securing ring, the flexible band assumes a suitable position in which the wall of the flexible band includes a sufficiently acute angle which as far as possible should not exceed 30°, with the wall of the outer portion of the tamperproof band or with the axis of the closure.

In principle it is admittedly possible to produce corresponding screw closures and flexible bands thereof with relatively small tolerances which range in the region of ±0.1 mm, but there are some types of container and some types of closure in which the corresponding counterpart portion, namely a container neck or however also a lower closure portion, have not also been produced or cannot also be produced with a corresponding accuracy.

That applies in particular to containers of extrusion-blown plastic (HDPE, PET and so forth), in which the bottle neck is shaped together with the blowing operation and in part also by the blowing operation. In contrast to container necks produced by injection moulding, in this case at least the inner part of the "mould" is replaced by gas (generally air) under a suitable pressure.

The container necks produced by blow moulding therefore often involve substantially greater inaccuracies and typical tolerances of up to ±0.3% or more. That has a detrimental effect in particular with large diameters of 35 mm and above because in such a case screw caps with corresponding flexible bands which are intended for the target dimension of such container necks or also lower closure portions, no longer exactly match the container necks produced in that way. It can happen for example that, in the case of a container neck produced by blow moulding of a nominal diameter of 63 mm the outside diameter of the container neck below the securing ring in the case of a tolerance deviation of −0.3% is smaller than the target dimension by up to 0.2 mm. If then conversely the diameter of the tamperproof band of the associated closure cap has a tolerance deviation of +0.1 mm then the effective difference in the diameter of the tamperproof band in the region of the hinge portion and the outside diameter of the container neck beneath the securing ring is 0.3 mm in relation to the corresponding target dimension. In other words the upper end of the flexible band which forms the smallest diameter of the flexible band and bears with its inner upper edge against the outside surface of the bottle neck can deviate further radially inwardly by 0.15 mm (and in that case tilt about the hinge region) than when the target dimensions are met.

Even if the axial length of the flexible band from the hinge region to the free end is of the order of magnitude of only a few mm and is for example 3 mm then a further tilting movement of the upper portion of the flexible band inwardly through 0.15 mm, as even when the target dimensions are observed the wall of the flexible band is typically already tilted through up to 20° relative to the outer portion of the tamperproof band, signifies, when the specific geometries are accurately taken into account, an increase in the tilt angle (between flexible band and axis) by up to 5° so that when an axial force is applied to the free end of the flexible band that force is converted for a considerable part thereof into a force component which acts perpendicularly to the wall of the flexible band and which acts as a flexing force with respect to the hinge portion and can lead to so-called "unrolling", that is to say folding over of the flexible band around the hinge portion.

That risk is made even worse because inevitably some portions of the tamperproof band tear away first of all and then slip down under the effect of the force of gravity on the container neck which typically is below the securing ring and tapers away from the securing ring so that the flexible band acquires even more play and can be even more easily unrolled or folded over on the opposite side, without the tamperproof band tearing away from the cap peripheral wall portion in that region. As a result therefore such tolerance deviations mean that either the flexible band is folded back and does not become detached at all from the cap peripheral wall portion, or however it is only partially detached from the cap and still hangs at least in a relatively small region on the peripheral wall portion of the cap. The consumer will then generally tear off such a tamperproof band which is hanging down loosely and which is a nuisance when re-using the screw cap, or the tamperproof band can also of itself tear away in further handling of the closure, which in turn entails the risk that it drops into the container or drops into another container into which the liquid contained in the container is to be poured out. For example the liquid or substance in the container provided with the screw closure could be introduced into a mixer or a portioning device, in which case a tamperproof band which unintentionally drops into the mixer can lead to considerable operational disturbances.

In addition, a tamperproof band which can be detached from a container neck by unrolling of the flexible band, without the tamperproof band tearing away from the screw cap, would increase the risk of manipulation of the container content as then such a condition could also be intentionally brought about in order to replace and/or alter the container content.

Therefore the object of the present invention is to provide a screw closure having a flexible band, which even with relatively great tolerance deviations between closure and container neck, still guarantees that the tamperproof band is reliably torn away and thus affords increased functional security.

That object is attained in that the portions with the larger wall cross-section are of an upwardly enlarging, wedge-shaped cross-section, wherein the upper edge of the folded-over flexible band includes the furthest radially inwardly protruding projections.

Desirably the upper inner edge of the less stretchable portions in the folded-over condition of the flexible band defines the smallest diameter of the latter so that this upper inner edge in use bears against the bottle neck beneath the securing ring.

In particular the less easily stretchable portions have radially inwardly protruding projections defining the smallest inside diameter of the folded-over flexible band.

The radially inwardly protruding projections are provided at the upper free end of the flexible band. In addition projections which are nose-shaped or triangular in cross-section are preferred, which form the upper end portion of the less easily stretchable portions and have their maximum radial extent at the free end of the flexible band. The top side of the projections then forms a part of the surface coming into engagement with the underside of a securing ring. It will be appreciated however that the projections can also be of substantially any other cross-sectional shapes, for example rectangular, or can be provided with more complex, polygonal or also rounded-off contours.

The more easily stretchable portions are formed by portions of a smaller wall cross-section, in particular by portions which in the folded-over condition are of a smaller wall thickness measured in the radial direction than the other less easily stretchable portions. Those less easily stretchable portions or the portions of the larger wall cross-section are of an upwardly enlarging cross-section, wherein the upper edge of the folded-over flexible band includes the furthest radially inwardly protruding projections. The cross-sections referred to here are moreover always defined by cross-sectional planes which extend through the axis of the screw cap and a radius starting from the axis.

The projections therefore inevitably also cause an effective increase in the size of the cross-section of the flexible band, which in turn contributes to less easy stretchability of those portions.

In that respect it has proven to be desirable if there are provided between 5 and 15 more easily stretchable portions alternating with respectively interposed less easily stretchable portions distributed over the periphery of the flexible band.

The advantage of a flexible band which distributed over its periphery has a plurality of more easily stretchable portions and therebetween less easily stretchable portions which in the folded-over condition also have still radially inwardly protruding projections is that such a flexible band is even better suited to compensating for relatively large tolerance deviations. In particular such a flexible band can be designed and produced from the outset with a smaller target dimension in respect of its inside diameter, wherein that inside diameter of the flexible band is the free inside diameter of the flexible band, which occurs in the upwardly folded-over condition of the flexible band. In the present case that inside diameter is defined by the respective inwardly protruding projections of the less easily stretchable portions. If those projections define a relatively small radius the actual wall of the flexible band, which is defined by the connection from the hinge portion through the centre of the wall portion extending therefrom, is still always relatively steep and at a highly acute angle or almost parallel to the outside wall of the tamperproof band or the axis of the closure.

In that respect the more easily stretchable portions provide that, in spite of that relatively small inside diameter of the flexible band, the latter nonetheless can be moved over the securing ring which is of a markedly larger outside diameter, without tearing.

The radially most inwardly protruding projections are in that case of such a configuration that they are comparatively easily deformable and thus additionally facilitate pushing the flexible band over the securing ring.

In an embodiment the wall of the flexible band, that is radially outwards in the folded-over condition, after the screw cap is fitted onto a container closure involving the target dimension, defines an approximately conical peripherally extending wall portion with a relatively acute cone angle corresponding to the angle between the wall of the flexible band and the axial direction. The wall of the flexible band, which is disposed radially outwardly in the folded-over condition, in addition to that conically peripherally extending basic shape at the upper end of the flexible band, can also have a radially outwardly slightly thickened bead or bead edge. Matching same in the preferred embodiment of the invention the tamperproof band has on its inside surface a corresponding peripherally extending recess for receiving that bead edge. When the bead edge is pressed completely into the recess the wall of the flexible band extends almost parallel to the outer portion of the tamperproof band or parallel to the axial direction. The flexible band assumes that position in particular when it is moved beyond the securing ring and in that case is enlarged to its maximum.

Insofar as in a preferred embodiment the outside wall of the flexible band in the folded-over condition defines a conical wall or has a conical wall as the envelope, the acute angle between the flexible band and the axis of the closure is desirably defined by the cone angle measured towards the axis. For carrying the force directed substantially along the flexible band from the free end towards the hinge portion, when the top side of the flexible band comes into engagement with the underside of the securing ring, the important consideration is essentially the steep orientation of the outer wall portions of the flexible band in order to avoid a flexural force directed perpendicularly to the wall of the flexible band and to transmit the force predominantly in the form of an axial tensile force to the outer tamperproof band portion. A small angle between the conical outer wall of the flexible band and the axis of the screw cap is in particular a good measure and indication in terms of operability of the tamperproof band.

In a preferred embodiment of the invention the thick-walled portions with the radially inwardly protruding projections in the peripheral direction respectively take up between two and ten times the corresponding peripheral portions of a stretchable or thin-walled portion.

In a specific variant of a closure with a nominal diameter of 65 mm there are in total nine more easily stretchable portions alternately with less stretchable portions, wherein the more easily stretchable portions respectively occupy approximately a fifth of those peripheral portions which are respectively occupied by the less easily stretchable portions.

The less easily stretchable portions can be still further structured in themselves by for example the respective end portions, disposed in the peripheral direction, of the upper edge of the less easily stretchable peripheral portions each having still somewhat more pronounced and further radially inwardly protruding nose-shaped projections than the regions disposed therebetween. Those end portions can also once again constitute approximately a tenth to a quarter of the corresponding peripheral portion.

As already mentioned the approximately nose-shaped projections are of a substantially triangular basic shape and are provided at the inside of an already wedge-shaped wall cross-section of the thicker-walled portions. If the wedge profile of those portions is already interpreted as a projection in accordance with the meaning of claim 1, in comparison with the profile of the thin-walled, more easily stretchable portions, the cross-sectional profile of the less easily stretchable portions in a preferred embodiment can also be described to the effect that the triangular projections have a hypotenuse which is kinked inwardly, that is to say into the triangular profile. The result of this is that the upper end portion of the radially inwardly protruding projections is then of a still somewhat more acute-angled cross-section, that is to say the angle between the top side of the flexible band which includes the top side of the nose-shaped projections and the inside surface of the nose-shaped projections becomes still somewhat smaller than without a correspondingly inwardly kinked hypotenuse.

Preferably the invention is intended for screw caps whose nominal diameter is at least 35 mm, wherein the advantages are enjoyed to an even greater degree if the nominal diameter of the screw cap becomes larger, that is to say is in particular at least 50 mm.

The invention is also directed to the combination of a container and a screw cap which can be screwed onto the container neck, with a container neck and a securing ring which is formed thereon and which surrounds the container neck and which projects flange-like outwardly. In regard to that combination the object of the invention is attained in that the screw cap has the features of at least one of claims 1 to 11.

In that respect the inside diameter of the flexible band, which is defined by the less easily stretchable portions of the flexible band when folded over ready for use, should be in particular less than the outside diameter of the bottle neck immediately below the securing ring, which means that, after fitment of the closure, the flexible band is held enlarged by the bottle neck beneath the securing ring and bears in a stressed condition against the bottle neck. In addition in the preferred variant of such a combination it is provided that the outside diameter of the bottle neck narrows below the securing ring and with an increasing distance therefrom. That substantially conical narrowing downwardly provides that the detached tamperproof band moves downwardly along the bottle neck because of the stress with which the flexible band bears against the conical surface, and it cannot be displaced upwardly in order for example to simulate a tamperproof band which is still fixedly connected to the screw cap, with a manipulative intention.

Figure 2:
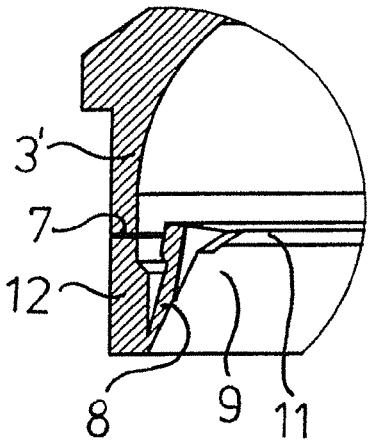
Figure 3:
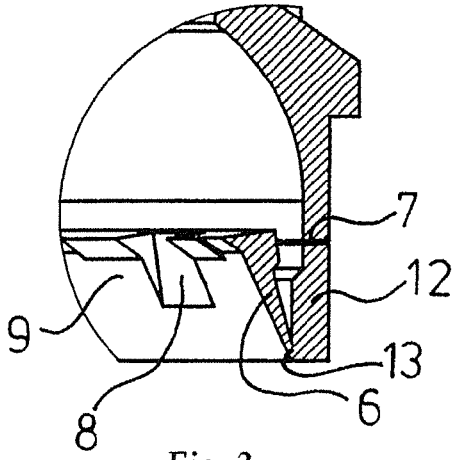
Figure 4:
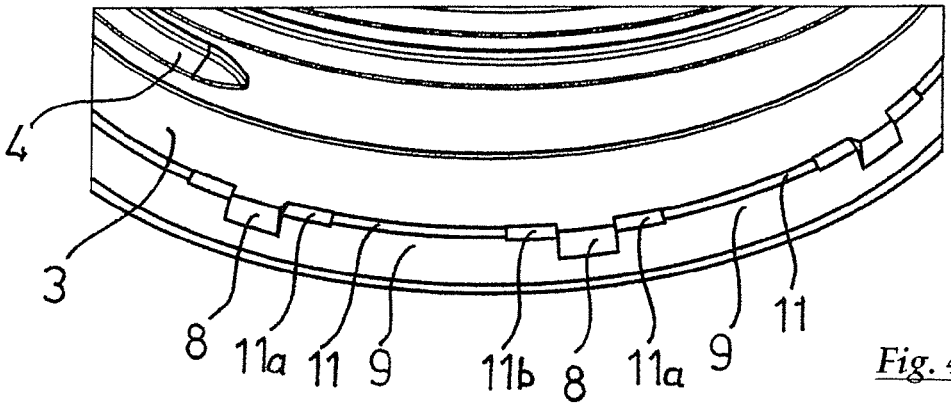
Figure 5:
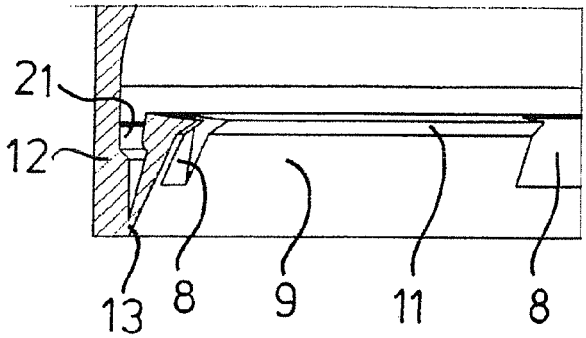
Figure 6:
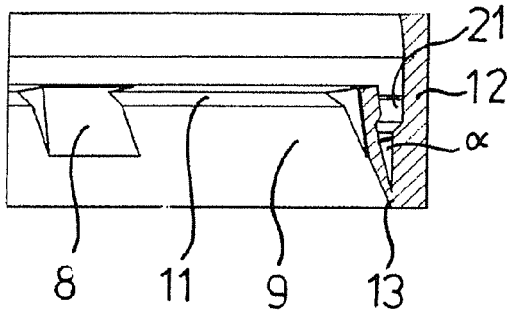
Figure 7:
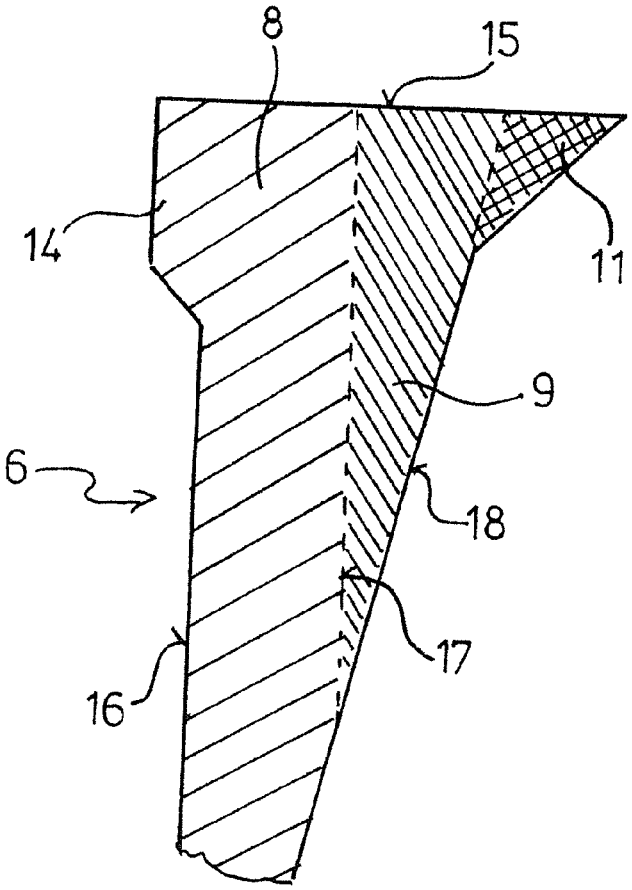

Further features, advantages and possible uses of the present invention will be apparent from the description hereinafter of a preferred embodiment and the related Figures in which:

FIG. 1 shows an axial cross-section through a closure according to the invention with a flexible band folded over ready for use, FIG. 2 shows an enlargement from FIG. 1 corresponding to the circle A shown in FIG. 1, FIG. 3 shows an enlargement of the portion B in FIG. 1, FIG. 4 shows a perspective internal view of the lower portion of the screw closure with the flexible band folded over ready for use, FIG. 5 shows a further enlarged view of a portion of the flexible band folded over ready for use, partly in section, in accordance with a second embodiment, FIG. 6 shows a further partially sectional perspective view of a flexible band portion with a section line through a more easily stretchable portion, FIG. 7 shows a still further enlarged cross-sectional view of a flexible band, and FIGS. 8 to 10 show various views of a further embodiment.

FIG. 1 shows the screw closure generally identified by reference 10, comprising a screw cap 1 and a tamperproof band 5. The screw cap 1 in turn comprises a substantially flat head plate 2 in the shape of a circular disc and an approximately cylindrical cap peripheral wall portion 3 having a female screwthread 4 adapted for screwing onto the correspondingly sized male screwthread on a container neck. It is also possible to see a projecting edge which extends upwardly from the head plate but which is of subordinate significance for the present invention. In the lower region the cap peripheral wall portion also has a cylindrical enlargement 3' to which is joined the outer portion 12 of a tamperproof band 5 by way of easily tearable connections (not shown).

The enlarged portions of FIG. 1 as shown in FIGS. 2 and 3 more clearly show the tamperproof band 5 which is separate from the screw cap and the peripheral wall portion 3 and which comprises an outer, substantially cylindrical outer tamperproof band portion 12 formed as a prolongation of the enlargement 3' of the peripheral wall portion 3, and the flexible band 6, which are connected together by way of a hinge region 13. The closure is produced with a flexible band 6 which upon and after manufacture is folded out approximately as a prolongation of the outer tamperproof band portion 12 or is of a slightly inwardly conically angled configuration. For use the flexible band 6 is folded over inwardly and upwardly around the hinge region 13. The top side or upper surface 15 of the folded-over flexible band, after being applied to a container neck, is disposed opposite the underside of a corresponding securing ring which is provided as a flange-like enlargement on the outside of the container neck.

As will be seen the flexible band 6 in the lower region and in a region 9 of greater wall thickness is of a narrow wedge-shaped cross-section. It will be appreciated that this cross-section does not necessarily have to be of a narrow wedge-shape but could also be constant immediately above the hinge region, with a uniform wall thickness over the length. The length or longitudinal direction can be defined as the shortest connection from the hinge region 13 to the free end with the upper edge face 15. FIG. 2 in particular shows the cross-section of the flexible band 6 in a more easily stretchable portion 8 which, starting from the hinge region, is of an almost constant small thickness with at the same time a markedly greater length, and thus clearly defines the "longitudinal direction" of the flexible band 6. The conical outside wall 16 extends on the one hand in the peripheral direction and on the other hand in the longitudinal direction just defined above.

It will be seen from FIG. 1 that the folded-over flexible band 6 comprises different portions 8 and 9, wherein the portions 8 are of a smaller wall thickness (see the sectional view in FIGS. 2 and 3 or FIGS. 5 and 6) so that those portions are more easily stretchable solely by virtue of the cross-sectional geometry than the other portions 9 whose cross-section can be seen for example in FIG. 3 (or FIG. 5). The portions 8 and 9 can be particularly clearly seen and distinguished in FIG. 4, in which respect it will be seen that in the embodiment illustrated here (which is also shown in FIGS. 1 to 3) the portions 9 in turn still have an inner structure, namely insofar as the portions or parts forming the ends of the portion 9 in the peripheral direction have still somewhat more pronounced, radially inwardly protruding projections 11*a*, 11*b* of triangular cross-section.

Those separate projections 11*a*, 11*b* are not provided in the embodiment of FIGS. 5 and 6.

The tamperproof band 5 is joined to the lower enlarged edge 3' of the peripheral wall portion 3 of the cap at 7 by way of easily tearable elements or by way of a peripherally extending continuous weak location.

When the screw cap 1 is released from the container neck by unscrewing the entire screw closure 1 together with the tamperproof band moves upwardly in the axial direction, with the top side 15 bearing against the underside of a securing ring (not shown).

In that situation the flexible band adopts approximately the position which can be clearly seen from FIGS. 2 and 3 (or FIGS. 5 and 6) with an inclination relative to the axis of the closure or relative to the direction defined by the outer cylindrical tamperproof band portion 12. The nose-shaped projections 11 or 11*a*, 11*b* bear in that case against the outside surface of the bottle neck (not shown) beneath the securing ring and hold the flexible band 6 in the illustrated, relatively upright position in which the wall 16 or longitudinal direction of the flexible band 6 extends at a comparatively acute angle $\alpha$ relative to the cylindrical wall of the outer tamperproof band portion 12.

In that position the axial pressure forces between the flexible band 6 and the securing ring, that act from above almost perpendicularly on the surface 15, are transmitted substantially in the longitudinal direction of the flexible band 6 and by the wall thereof to the hinge region 13 and from there to the outer tamperproof band portion 12 so that a corresponding tensile force acts on the easily tearable elements 7 which finally tear when the force is increased by further unscrewing the screw cap 1. In that respect, in the course of the unscrewing process, all easily tearable elements or the weakening line between the tamperproof band 5 and the peripheral wall portion 3 of the cap should tear off along the entire periphery of the tamperproof band 5 so that the tamperproof band 5 is completely separated from the screw cap 1 or the peripheral wall portion 3 thereof and remains hanging on the container neck beneath the securing ring.

If the outside surface of the container neck tapers conically downwardly beneath the securing ring the stress in the flexible band 6 with which it bears against the outside of the bottle neck provides for downward slipping movement of the flexible band at that conical portion of the container neck so that a markedly visible spacing remains between the tamperproof band 5 and the closure cap which is possibly screwed back on again and indicates that the closure has already been opened at least once. In that way the tamperproof band in the intact condition, that is to say the condition of being fixedly joined to the screw cap 3, performs its function as guarantee that the container content is inviolate.

FIG. 7 shows the cross-section of the flexible band once again on an enlarged scale.

In that respect however it is to be emphasised that the relative dimensions and in particular the wall thicknesses which can be seen in this cross-sectional view do not necessarily have to be identical to the actual dimensions, even if they may come close to the actual relationships.

The more easily stretchable portions 8 which are of a smaller wall thickness are of a cross-section as indicated by the left-hand outside wall 16 and the vertical broken line 17, that wall thickness again tapering slightly downwardly towards the hinge region 13. In this cross-section the longitudinal direction of the flexible band is substantially the vertical or the wall 16 which extends from the hinge region 13 upwardly to the free end of the flexible band 6, that is defined by the end face 15.

In addition to the wedge-shape cross-section which can be seen between the inside wall 18 and the outside wall 17 and which thus in any case would already form a kind of radial projection or a radially inwardly protruding point at the upper end of the flexible band 6, the portions 9 of larger wall thickness also have the additional projections 11 which are nose-shaped or triangular in cross-section. The wedge-shaped cross-section and the additional projections 11 provide that the portions 9 are less easily stretchable than the portions 8.

Alternatively it would also be possible to describe the closely hatched and cross-hatched region in FIG. 7 as an approximately triangular projection which however is not exactly triangular, but has an inwardly kinked hypotenuse. The result of this is that the nose angle, that is to say the angle between the top side 15 of the flexible band and the lower or inside surface 19 of the projection 11, which corresponds to a cone surface with a relatively large cone angle, becomes still somewhat smaller and more acute, which converts the form of the tip of the nose-shaped projection 11 into a pointed lip which is relatively more easily deformable inwardly and upwardly in relation to radially outwardly acting pressure (such as for example during application and moving over a securing ring).

It will be appreciated that, instead of the kinked cross-sectional configuration, the right-hand flank or inside surface 18, 19 could also extend in an arcuately curved configuration downwardly, thereby achieving substantially the same effect.

Those nose-shaped projections 11 bear against the outer surface of a container neck beneath a securing ring and by virtue of their flexibility and their projecting relationship in relation to the wall portion defining the longitudinal direction, they can better compensate for larger tolerance deviations of container necks, than conventional flexible bands as the flexible bands can be produced in that way with smaller target dimensions in respect of their free inside diameter and can nonetheless be pushed over a securing ring and come to bear against the container neck.

It will be seen from FIGS. 2 and 3 and also FIGS. 5, 6 and 7 that the outer tamperproof band portion 12 is not of a constant wall thickness but is of a somewhat configuration in the upper region in order in that way to form a recess 21 in which a bead edge 14, that is to say an outwardly projecting thickening of the flexible band 6, can be accommodated, which serves to expand the flexible band 6 sufficiently far in the radial direction, in particular at the moment at which it has to be moved over the securing ring upon application of the closure, in which case the flexible nose-like projections 11 also contribute to the flexible band being able to pass over the securing ring upon application while remaining intact, at least when they are of a suitably acute-angled configuration, as was described hereinbefore, by virtue of their correspondingly easier deformability. It will be appreciated that the more easily stretchable portions 8 also contribute to corresponding radial enlargement of the flexible band 6, which permits the band to pass intact over the securing ring.

FIGS. 8 to 10 show a further embodiment of the present invention, which is the same in all essential details to the embodiments already described, but being shown here in section fitted on a bottle neck 20. The bottle neck 20 has a male thread 21 onto which the cap 10 is screwed with its female thread 4. Beneath the thread the bottle neck has a securing ring 22 whose outside diameter is again larger than the outside diameter of the thread 21, and whose underside, as can be seen in particular from the portions on an enlarged scale in FIGS. 9 and 10, extends substantially flat and perpendicularly to the common axis 30 of the bottle neck 20 and the screw cap 10.

In the left-hand half of FIG. 8 the tamperproof band 5 is shown as still being connected to the lower portion 3' of the peripheral wall portion of the cap by way of intact elements 7, wherein the flexible band 6 is completely beneath the securing ring 22 so that its flat top side 17 can come into contact with the flat underside 24 of the securing ring when the closure is moved upwardly by unscrewing. Contrary to the view in FIG. 9 the inwardly protruding projection of the flexible band 6 self-evidently does not overlap with the conical wall portion 23 of the bottle neck 20. The apparent overlap occurs in the Figure only because the sectional plane of the screw cap 10 is displaced somewhat rearwardly relative to the sectional plane through the bottle neck. FIGS. 9 and 10 each show portions on an enlarged scale from the lower left and right edge region in FIG. 8. On the right-hand side in FIG. 8 and correspondingly also in FIG. 10 the tamperproof band 5 is shown separated from the lower portion 3' of the peripheral wall portion 3, that is to say the easily tearable connecting elements 7 are interrupted or broken. Because the flexible band 6 bears against the outside of the conical wall portion 23 of the bottle neck under a radial stress the tamperproof band 5 slips completely downwardly until its lower edge rests on an enlargement of the bottle neck 20, as can be clearly seen in FIG. 10. The other details of the flexible band, in particular in regard to the alternating easily stretchable and less easily stretchable portions, are identical to the embodiments already described above, wherein it is only the shape of the radially inwardly protruding nose-like projections that differs somewhat from the above-discussed embodiments, by virtue of an inner edge rounding.

For the purposes of the original disclosure it is pointed out that all features as can be seen by a man skilled in the art from the present description, the drawings and the claims, even if they are described in specific terms only in connection with certain other features, can be combined both individually and also in any combinations with others of the features or groups of features disclosed here insofar as that has not been expressly excluded or technical aspects make such combinations impossible or meaningless. A comprehensive explicit representation of all conceivable combinations of features and emphasis of the independence of the individual features from each other is dispensed with here only for the sake of brevity and readability of the description.

The invention claimed is:

1. A screw closure (10) comprising a screw cap (1) and a tamperproof band (5), wherein the screw cap (1) has a head plate (2) with a cylindrical cap peripheral wall portion (3) provided with a female thread (4) and wherein the tamperproof band (5) has a flexible band (6), includes radially inwardly protruding projections and is connected to the lower edge of the cap peripheral wall portion (3) by way of one or more easily tearable elements (7), wherein the flexible band (6) is in the form of a continuously peripherally extending flexible band which distributed over its periphery has a plurality of more easily stretchable portions (8) and therebetween relatively less easily stretchable portions (9), and wherein the more easily stretchable portions (8) are of a smaller wall cross-section, than the less easily stretchable portions (9), characterised in that the portions with the larger wall cross-section are of an upwardly enlarging, wedge-shaped cross-section, wherein the upper edge of the folded-over flexible band includes the farthest radially inwardly protruding projections (11).

2. A screw closure according to claim 1 characterised in that the less stretchable portion comprises an upper inner edge, wherein the upper inner edge of the less stretchable portions (9) in the folded-over condition of the flexible band (6) defines the smallest inside diameter of the flexible band.

3. A screw closure according to claim 1 or claim 2 characterised in that the less easily stretchable portions have radially inwardly protruding projections (11) which define the smallest inside diameter of the folded-over flexible band (6).

4. A screw closure according to one of the preceding claims 1-2 characterised in that there are provided between 5 and 15 more easily stretchable portions (8) alternating with respectively interposed less easily stretchable portions (9) distributed over the periphery of the flexible band.

5. A screw closure according to one of the preceding claims 1-2 characterised in that the wall of the flexible band (6), that is radially outwards in the folded-over condition, defines an approximately conically peripherally extending wall portion (16).

6. A screw closure according to one of the preceding claims 1-2 characterised in that the wall (16) of the flexible band, that is radially outward in the folded-over condition, has a conically peripherally extending basic shape, wherein in addition at the upper end of the flexible band there is a radially outwardly slightly thickened bead edge (14).

7. A screw closure according to one of the preceding claims 1-2 characterised in that thick-walled portions (9) with the inwardly protruding projections (11) as measured in the peripheral direction respectively take up between three and ten times the peripheral portion of one of the stretchable thin-walled portions (8).

8. A screw closure according to one of the preceding claims 1-2 characterised in that the peripheral portions (9) of larger wall cross-section have at their respective ends in the peripheral direction upper end portions with respective still somewhat more pronounced and further radially inwardly protruding nose-shaped projections (11*a*, 11*b*), than the regions disposed therebetween.

9. A screw closure according to claim 8, charaterised in that the nose-shaped projections, have an inwardly kinked hypotenuse.

10. A screw closure according to one of the preceding claims 1-2 characterised in that the less stretchable wall portions (9) of larger wall cross-section differ from the more easily stretchable portions (8) of smaller wall cross-section only by additional radially inwardly protruding nose-shaped projections which are approximately triangular in cross-section in the upper region of the folded-over flexible band.

11. A screw closure according to claim 10, characterised in that the radially inwardly protruding nose-shaped projections are formed by a wedge-shaped cross-section of the less stretchable wall portions (9).

12. A screw closure according to one of the preceding claims 1-2 characterised in that the nominal diameter of the screw cap is at least 30 mm.

13. The screw closure according to claim 12, characterised in that the nominal diameter of the screw cap is at least 50 mm.

14. A combination comprising a bottle and a screw cap which can be screwed onto the bottle neck, having a bottle neck and a securing ring which is formed thereon and which surrounds the bottle neck and which projects flange-like outwardly, characterised in that the screw cap has the features of at least one of claims 1 to 2.

15. A combination according to claim 14 characterised in that the inside diameter of the flexible band, that is defined by the thick-walled portions of the flexible band which is folded over ready for use, is less than the outside diameter of the bottle neck directly below the securing ring.

16. A combination according to claim 15 characterised in that the outside diameter of the bottle neck decreases below the securing ring with an increasing distance from the securing ring.

* * * * *